United States Patent [19]

Kleppe et al.

[11] Patent Number: 4,560,437

[45] Date of Patent: Dec. 24, 1985

[54] PROCESS FOR DELIGNIFICATION OF CHEMICAL WOOD PULP USING SODIUM SULPHITE OR BISULPHITE PRIOR TO OXYGEN-ALKALI TREATMENT

[75] Inventors: Peder J. Kleppe; Sverre Storebraten, both of Moss, Norway

[73] Assignee: M. Peterson & Son A/S, Moss, Norway

[21] Appl. No.: 623,248

[22] Filed: Jun. 22, 1984

[30] Foreign Application Priority Data

Jun. 29, 1983 [NO] Norway ..... 832370

[51] Int. Cl.[4] ..... D21C 3/04; D21C 3/12; D21C 3/20; D21C 3/26

[52] U.S. Cl. ..... 162/65; 162/72; 162/84; 162/86

[58] Field of Search ..... 162/86, 65, 84, 36, 162/83, 72, 19, 82

[56] References Cited

U.S. PATENT DOCUMENTS

| | | | |
|---|---|---|---|
| 3,647,363 | 3/1972 | Chart et al. | 162/36 |
| 3,717,545 | 2/1973 | Hess et al. | 162/36 |
| 3,725,194 | 4/1973 | Smith et al. | 162/65 |
| 4,012,280 | 3/1977 | Holton | 162/72 |
| 4,145,246 | 3/1979 | Goheen et al. | 162/83 |

*Primary Examiner*—Steve Alvo

*Attorney, Agent, or Firm*—Owen, Wickersham & Erickson

[57] ABSTRACT

In the delignification of chemical wood pulp with oxygen and alkali a larger reduction of the kappa number may be obtained without an increase in the charge of oxygen or alkali, provided the pulp is pretreated with a solution of sulphite or bisulphite in order to introduce hydrophilic groups in the sulphate lignin in the chemical wood pulp.

2 Claims, No Drawings

PROCESS FOR DELIGNIFICATION OF CHEMICAL WOOD PULP USING SODIUM SULPHITE OR BISULPHITE PRIOR TO OXYGEN-ALKALI TREATMENT

BACKGROUND OF THE INVENTION

The invention relates to a method for delignification of chemical wood pulp by oxygen-alkali treatment.

Delignification with oxygen and alkali is today an industrially accepted process. The process is usually conducted as a pre-bleaching step before the final bleaching with chlorine containing chemicals. The kappa number of the pulp is then reduced usually from about 35 to 30 to a value of 20 to 15, implying a degree of delignification of about 40 to 50%. The values refer to oxygen-alkali delignification of sulphate pulps of coniferous woods.

It is also known that sulphate pulp having a kappa number within the range of 50 to 70 can be pre-bleached with oxygen and alkali. The reduction of the kappa number in such an oxygen-alkali delignification stage is usually restricted to 25 to 30 kappa number units.

Delignification with oxygen and alkali can be carried out both at high pulp consistency (25 to 30%) and at medium pulp consistency (7 to 10%). In the oxygen-alkali treatment of sulphate pulps having a kappa number in the range of 50 to 70 the process is usually carried out at medium pulp consistency. In the oxygen-alkali treatment of sulphate pulps having a kappa number in the range of 30 to 35 a high pulp consistency is mainly used.

In processes based on medium pulp consistency hydraulic reactors are used, i.e. liquid filled reactors having no gas phase in the reactor. The oxygen gas must be dispersed as small gas bubbles in the liquid phase surrounding the fibres. This means that there exists an upper limit for the amount of oxygen gas that can be charged to the reactor together with the pulp. This upper limit is defined by the pulp consistency, the reactor pressure and the reactor temperature. At a reactor pressure of 0,6 MPa, a pulp consistency of 8 to 10% and a reactor temperature of 95 to 110° C. the oxygen charge is restricted to ~40 kg $O_2$ per ton of 100% unbleached pulp. The kappa number reduction in such a stage using a medium pulp consistency is restricted to about 30 kappa number units.

In a reactor system based on high pulp consistency there is always a gas phase of oxygen present in the reactor. The charge of alkali governs the kappa number reduction. The strength characteristics of the pulp usually represent a limit for the kappa number reduction or the degree of delignification. A high alkali charge leads to a high alkali concentration. Furthermore, there is a relation between the carbohydrate decomposition and the alkali concentration. At high alkali concentrations the carbohydrate decomposition measured as the intrinsic viscosity of the pulp or yield loss is strongly increased. In order to reduce the decomposition of the carbohydrates magnesium salts are usually added. Another method known from the literature is to treat the sulphate pulp with an acid solution having a pH value of $<4$ prior to the oxygen-alkali delignification stage. In this manner heavy metal iones are removed from the pulp, whereby the decomposition of carbohydrates is reduced.

It is still necessary to limit the alkali charge to about 25 to 35 kg NaOH per ton of 100% unbleached pulp in order to limit the carbohydrate decomposition to an acceptable level. This limits the kappa number reduction to about 20 units.

SUMMARY OF THE INVENTION

The object of the present invention is to provide an industrially acceptable delignification process allowing an increase of the kappa number reduction in an oxygen-alkali delignification stage without increasing the charge of oxygen and alkali. It has been found that this may be done by modifying the residual lignin in the unbleached sulphate pulp. Specifically, the modification involves introducing hydrophilic groups in the sulphate lignin to make it more easily dissolved in the subsequent oxygen-alkali delignification stage.

The introductioh of hydrophilic groups may preferably be effected by sulphonating sulphate or polysulphide pulps with a solution of sodium sulphite or sodium bisulphite prior to the oxygen-alkali delignification. It has further been found that absorption liquor from industrial stack gas scrubbers is well suited as a pretreatment solution prior to the oxygen-alkali delignification. This makes the pretreatment practically costless. Other sources of $SO_2$ can also be used for pretreatment of the pulp.

DETAILED DESCRIPTION OF THE INVENTION

The invention is illustrated in more detail by the subsequent examples. The first six examples describe laboratory experiments with a sulphite treatment followed by an oxygen-alkali delignification. The next six examples relate to experiments in production plant scale.

CONTROL EXAMPLE A

The treated pulp was an industrially produced polysulphide pulp of spruce and pine. The kappa number was measured as 62.2. This pulp was delignified in the laboratory with oxygen and alkali. $O_2$ pressure 0.8 MPa (20° C.), temperature 110° C., 10% pulp consistency and 45 min reaction time. The alkali charge was 25 kg NaOH per ton of 100% pulp. To stabilize the pulp against carbohydrate decomposition 1 kg $Mg^{++}$ per ton of 100% pulp was added. After oxygen-alkali delignification the pulp was washed and the kappa number was determined.

EXAMPLE 1

The same pulp as in control example A was treated with a sodium sulphite solution at a pH value of 8.0, a temperature of 88° C., a pulp consistency of 10% and a treatment time of 60 min. The sulphite charge was 10 kg calculated as $SO_2$ per ton of 100% pulp. After the sulphite pretreatment the pulp was washed. This pulp was further delignified with oxygen and alkali in the laboratory. $O_2$ pressure 0.8 MPa (20° C.), 110° C., 10% pulp consistency and 45 min reaction time. The alkali charge was 25 kg NaOH per ton of 100% pulp. 1 kg $Mg^{++}$ per ton of 100% pulp was added as an inhibitor. After oxygen-alkali delignification the pulp was washed and the kappa number was determined.

EXAMPLE 2

The same pulp as in control example A was treated with a sodium sulphite solution at a pH value of 8.0, a temperature of 88° C., a pulp consistency of 10% and a treatment time of 60 min. The sulphite charge was 30 kg calculated as $SO_2$ per ton of 100% pulp. After the sulphite pretreatment the pulp was washed. This pulp was further delignified with oxygen and alkali in the laboratory. The same conditions as described in example 1 were used.

CONTROL EXAMPLE B

The treated pulp was a laboratory produced sulphate pulp of spruce having a kappa number of 98.3. This pulp was further delignified with oxygen and alkali in the laboratory. $O_2$ pressure 0.8 MPa (20° C.), 110° C., 10% pulp consistency and 75 min reaction time. The alkali charge was 40 kg NaOH per ton of 100% pulp. 1 kg $Mg^{++}$ per ton of 100% pulp was added as an inhibitor. After oxygen-alkali delignification the pulp was washed and the kappa number was determined.

EXAMPLE 3

The same pulp as in control example B was treated with a sodium sulphite solution at a pH value of 8.0, a temperature of 88° C., a pulp consistency of 10% and a treatment time of 60 min. The sulphite charge was 10 kg calculated as $SO_2$ per ton of 100% pulp. After the sulfite pretreatment the pulp was washed. This pulp was further delignified with oxygen and alkali in the laboratory. The same conditions as described in control example B were used.

EXAMPLE 4

The same pulp as in control example B was treated with a sodium sulphite solution at a pH value of 8.0, a temperature of 88° C., a pulp consistency of 10% and a treatment time of 60 min. The sulphite charge was 30 kg calculated as $SO_2$ per ton of 100% pulp. After the sulphite pretreatment the pulp was further delignified with oxygen and alkali in the laboratory under the same conditions as in control example B.

The examples 5 to 7 and the control examples C to E relate to experiments in production plant scale. The pulps had been produced by polysulphide digesting in a continuous Kamyr digester having a "Hi-Heat" washing zone in the lower part of the digester. The wash water is added at the bottom of the digester and washes the pulp in counter current. A part of the pulp is blown through an in-line splitter to an oxygen-alkali delignification plant of the type Kamyr MC (medium consistency). This plant consists of a receiver standpipe, an MC pump, a pressure diffuser washer, an in-line disc refiner, an MC mixer, a hydraulic reactor, a small flash cyclone and a wash press. The wash liquor from the wash press is used as wash water in the pressure diffuser.

The kappa numbers refer to average values over one day.

CONTROL EXAMPLE C

The treated pulp was an industrial polysulphide pulp which was further delignified with oxygen and alkali after an intermediate wash in a continuous pressure diffuser. The charges of oxygen and alkali were 29 kg $O_2$ and 34 kg NaOH, respectively, per ton of 100% pulp.

Other conditions in the oxygen-alkali stage were: temperature 103° C., pulp consistency about 9% and reactor pressure 0.6 MPa (absolute). The retention time in the reactor was 35 min.

After the oxygen-alkali delignification the pulp was washed and the kappa number was determined.

EXAMPLE 5

The treated pulp was an industrial polysulphide pulp which was treated with a sulphite solution prior to further delignification with oxygen and alkali. The sulphite solution was added to the wash water passed to the bottom of the digester in an amount corresponding to 25 to 30 kg $SO_2$ per ton of 100% pulp. The conditions were: temperature about 85° C., pulp consistency about 9% and treatment time about 5 min. After the sulphite pretreatment the pulp was washed in a continuous pressure diffuser prior to addition of oxygen and alkali in amounts of 29 kg $O_2$ and 34 kg NaOH, respectively, for each ton of 100% pulp. Other conditions were: temperature 103° C., pulp consistency 9% and reactor pressure 0.6 MPa (absolute). The retention time in the reactor was 35 min. After the oxygen-alkali treatment the pulp was washed and the kappa number was determined.

CONTROL EXAMPLE D

The same treatment procedure as in control example C was used. The charges of oxygen and alkali were in this case 35 kg $O_2$ and 41 kg NaOH, respectively, per ton of 100% pulp. The reaction conditions in the oxygen-alkali stage were the same as described in example 5. After the oxygen-alkali stage the pulp was washed and the kappa number was determined.

EXAMPLE 6

The pulp was an industrial polysulphide pulp which was treated with a sulphite solution prior to further delignification with oxygen and alkali. The sulphite pretreatment was the same as described in example 5. After the sulphite pretreatment the pulp was washed in a continuous pressure diffuser prior to addition of oxygen and alkali in amounts of 35 kg $O_2$ and 42 kg NaOH, respectively, per ton of 100% pulp. The conditions in the oxygen stage were the same as described in example 5.

After the oxygen-alkali stage the pulp was washed and the kappa number was determined.

CONTROL EXAMPLE E

The same procedure as in control example C was used. The charges of oxygen and alkali were in this case 35 kg $O_2$ and 45 kg NaOH, respectively, per ton of 100% pulp. In this example oxidized white liquor was used as an alkali source. The reaction conditions in the oxygen stage were the same as in example 5. After the oxygen-alkali stage the pulp was washed and the kappa number was determined.

EXAMPLE 7

The pulp was an industrial polysulphide pulp which was treated with a sulphite solution in the lower part of the Kamyr digester as described in example 5.

Subsequent to the sulphite pretreatment the pulp was washed in a continuous pressure diffuser prior to the addition of oxygen and alkali in amounts of 39 kg $O_2$ and 44 kg NaOH, respectively, per ton of 100% pulp. Oxidized white liquor was used as an alkali source. The reaction conditions in the oxygen-alkali stage were otherwise the same as described in example 5. After the oxygen-alkali delignification the pulp was washed and the kappa number was determined.

The kappa numbers are given in the Table. As seen from the examples an increased kappa number reduction is obtained in the oxygen-alkali pretreatment when the pulps are pretreated with a sulphite solution.

At a given kappa number of the unbleached pulp considerably lower kappa numbers can be obtained after an oxygen-alkali delignification if the pulp has been pretreated with a sulphite solution. When the pulp is bleached with chlorine containing chemicals the increased kappa number reduction in the oxygen-alkali stage means that the consumption of bleaching chemicals can be substantially reduced. Additionally, the effluent of chlorine containing waste liquors is reduced. Thus, the sulphite pretreatment leads to an environmental advantage.

If the kappa number after the oxygen-alkali stage is maintained constant, the pretreatment of the pulp with a sulphite solution prior to the oxygen-alkali delignification stage implies that the kappa number of the unbleached pulp can be increased.

TABLE

| | Sulphite charge, kg $SO_2$ per ton of unbleached pulp | Kappa number | | Kappa number reduction |
|---|---|---|---|---|
| | | unbleached | $O_2$ bleached | |
| Control example A | 0 | 62.2 | 42.2 | 20.0 |
| Example 1 | 10 | 62.2 | 37.4 | 24.8 |
| Example 2 | 30 | 62.2 | 34.9 | 27.3 |
| Control example B | 0 | 98.3 | 50.5 | 47.8 |
| Example 3 | 10 | 98.3 | 47.4 | 50.9 |
| Example 4 | 30 | 98.3 | 45.6 | 52.7 |
| Control example C | 0 | 55.9 | 29.2 | 26.7 |
| Example 5 | 25–30 | 58.2 | 25.7 | 32.5 |
| Control example D | 0 | 61.3 | 32.4 | 28.9 |

TABLE-continued

| | Sulphite charge, kg $SO_2$ per ton of unbleached pulp | Kappa number | | Kappa number reduction |
|---|---|---|---|---|
| | | unbleached | $O_2$ bleached | |
| Fxample 6 | 25–30 | 66.8 | 30.8 | 36.1 |
| Control example E | 0 | 59.2 | 33.0 | 26.2 |
| Example 7 | 25–30 | 65.1 | 30.0 | 35.1 |

This gives a higher pulp yield, thereby reducing the cost of wood for each ton of pulp.

The effect of the invention has been demonstrated in connection with an oxygen-alkali delignification stage at medium pulp consistency, but those skilled in the art will expect that the same will also hold true in the case of oxygen-alkali delignification at higher pulp consistencies.

In the examples ordinary sulphate and polysulphide pulps are used, but those skilled in the art will expect that corresponding results will also be obtained with sulphate and polysulphide pulps digested with an addition of anthraquinone to the cooking liquor and with soda pulps with or without addition of anthraquinone. The effect will also be present in the casing of treating the pulp with a sulphite or bisulphite solution between two oxygen-alkali delignification stage. Especially, the invention may be utilized in the oxygen-alkali delignification of pulps having higher kappa numbers than 30 to 35.

What we claim is:

1. In a process for delignification of chemical wood sulfate or polysulfide pulp having a Kappa number of at least 30 by oxygen-alkali treatment, the step of treating the chemical wood pulp with a solution of either sodium sulfite or sodium bisulfite in an amount effective to enhance Kappa number reduction without increasing the amount of oxygen and alkali used during the oxygen-alkali treatment, prior to oxygen alkali treatment.

2. The process of claim 1 wherein the sulfate or polysulfite pulp has been processed with a cooking liquor containing anthraquinone.

* * * * *

UNITED STATES PATENT AND TRADEMARK OFFICE

CERTIFICATE OF CORRECTION

PATENT NO. : 4,560,437

DATED : December 24, 1985

INVENTOR(S) : Peder J. Kleppe and Sverre Storebraten

It is certified that error appears in the above-identified patent and that said Letters Patent are hereby corrected as shown below:

Column 6, line 26, "casing" should read --case--.

Column 6, lines 41 and 42, "polysulfite" should read --polysulfide-

Signed and Sealed this

*Eighteenth* Day of *March 1986*

[SEAL]

*Attest:*

DONALD J. QUIGG

*Attesting Officer*

*Commissioner of Patents and Trademarks*